US006681603B1

(12) United States Patent
Yu

(10) Patent No.: US 6,681,603 B1
(45) Date of Patent: Jan. 27, 2004

(54) STEEL CABLE LOCK STRUCTURE WITH INTERNAL MULTIDIRECTIONAL LOCKING EFFECT

(76) Inventor: Chun Te Yu, No. 41-21, Kian-Tsui St., Hsia-Nien Tsun, Fu-Hsing Hsiang, Changhua County (TW)

( * ) Notice: Subject to any disclaimer, the term of this patent is extended or adjusted under 35 U.S.C. 154(b) by 0 days.

(21) Appl. No.: 10/359,596

(22) Filed: Feb. 7, 2003

(51) Int. Cl.[7] ..... E05B 37/02
(52) U.S. Cl. ..... 70/18; 30/233
(58) Field of Search ..... 70/18, 30, 49, 70/58, 233

(56) References Cited

U.S. PATENT DOCUMENTS 4,033,160 A * 7/1977 Mima ..... 70/233
4,543,806 A * 10/1985 Papandrea et al. ..... 70/30
4,896,517 A * 1/1990 Ling ..... 70/18
5,156,028 A * 10/1992 Jiang ..... 70/30
5,786,759 A * 7/1998 Ling ..... 70/30 X
5,960,652 A * 10/1999 Marmstad ..... 70/49
6,192,719 B1 * 2/2001 Stukas et al. ..... 70/18
2002/0129628 A1 * 9/2002 Skalberg ..... 70/18

* cited by examiner

*Primary Examiner*—Lloyd A. Gall
(74) *Attorney, Agent, or Firm*—Troxell Law Office PLLC

(57) ABSTRACT

Steel cable lock structure with internal multidirectional locking effect, including a housing, a cable winding device, a locking device and a steel cable clutch controller. The housing has an interior space including a first and a second chambers. The cable winding device includes a reel pivotally disposed in the second chamber. A certain length of steel cable is wound on the reel. An engaging head is connected with an outer end of the steel cable. The locking device is fitted in the first chamber for controlling unlocking/locking operation. The steel cable clutch controller is disposed in the second chamber between the locking device and the cable winding device. The steel cable clutch controller includes a two-way abutting bar pressable by the engaging head when inserted, a button bar and a lower end press button restricted by the two-way abutting bar and the cooperative button bar. The button bar is drivingly connected with a dog, whereby in locked state, when the engaging head is inserted and locked, the lower end press button, cable winding device and steel cable are synchronously effectively locked.

15 Claims, 7 Drawing Sheets

STEEL CABLE LOCK STRUCTURE WITH INTERNAL MULTIDIRECTIONAL LOCKING EFFECT

BACKGROUND OF THE INVENTION

The present invention is related to a steel cable lock structure with internal multidirectional locking effect, which can be easily operated to control the winding and unwinding of the steel cable in multiple directions.

FIG. 7 shows a conventional steel cable releasing/retracting controlling structure of a steel cable lock (Taiwanese Patent Publication No. 131371). The lock includes a housing 50, a steel cable retracting/releasing device 51, multiple numeral wheels 52, a press button lock bolt 53, a resilient abutting pin 54 and steel cable clutch controller 55. The rear end of the steel cable retracting/releasing device 51 is equipped with an engaging head 511 which can be inserted and locked in a latch hole 501. When the engaging head 511 is inserted and locked, the abutting pin 54 is pressed to move toward the press button 551 in the housing 50. The steel cable clutch controller 55 is disposed on the lower press button 551 which is pivotally disposed on a shaft 552 at the button hole. The press button 551 has a button bar 553 extending to inner side of the housing 50. The innermost end is connected with a dog 554 for engaging with the ratchets of the reel. A stop board 556 is connected with upper side of the press button 551. In locked state, the stop board 556 is stopped by lower end of the pressed abutting pin 54, whereby the press button 551 cannot be pressed. The button bar 553 via a button spring 558 is resiliently connected with a cable pressing plate 557 to push the dog 554 in normal state to engage with the ratchets 555 of the reel. When the dog 554 is engaged with the ratchets 555, the cable pressing plate 557 presses the steel cable 512 to prevent the steel cable 512 from being drawn. When the lower press button 551 is released, the cable pressing plate 557 synchronously presses the steel cable 512 to further prevent the steel cable 512 from rushing back into the housing 50 due to inertia when the cable winding device 51 is instantaneously stopped by the dog 554. This avoids loosening of the wound cable and truly controls the extensible length of the steel cable 512. However, there are still some shortcomings existing in the operation of the dog 554 as follows:

1. The center of the pivot shaft 552 of the dog 554 is positioned behind the dog 554. Accordingly, when the dog 554 is engaged with the ratchets 555 of the reel, the length from the center of the pivot shaft 552 to the tip of the dog 554 is longer than the length from the center of the pivot shaft 552 to the tip of the ratchets 555. This causes that when the dog 554 is turned to disengage from the ratchets 555, it is necessary to first apply a force to push and reversely turn the reel. In addition, the application force arm is shorter than the resistance force arm. Therefore, it is necessary to apply a greater force for pressing the press button to disengage the dog 554 from the ratchets 555. Under such circumstance, the reel can be rotated to release the steel cable 512.
2. It can be found from FIG. 7 that the steel cable 512 is pulled in such a direction that a push force is exerted onto the cable pressing plate 557 and the button bar 553 to loosen the same. This makes it impossible to truly restrict the steel cable 512 and the reel. In addition, due to the pulling force exerted onto the cable pressing plate 557 by the steel cable 512, a very great torque is created at the pivot shaft 552 of the steel cable clutch controller 55. This is very likely to lead to damage of the stop board 556.
3. Moreover, the inner end of the resilient abutting pin 54 must bear greater lateral pressing force coming from the button bar 553 when locked. Such lateral pressing force exerted onto the end section is not an optimal force application measure with respect to the resilient abutting pin 54. (The optimal measure should be an action force in axial direction of the abutting pin.) This tends to bias the resilient abutting pin 54 to abrade the wall of the pin hole through which the abutting pin 54 is passed.
4. When locked, the inner end of the resilient abutting pin 54 extends into the swinging space of the stop board 556 to stop the stop board 556 so as to prevent the press button 551 from being pressed. However, it is found that the length from the center of the pivot shaft 552 to the stop board 556 is much shorter than the length from the center of the pivot shaft 552 to the rear end of the dog 554 or the button bar 553. Therefore, in locked state, in the case that a small gap exists between the stop board 556 and the resilient abutting pin 54, the rear end of the dog 554 or the button bar 553 may have larger swinging tolerance. This seriously affects the reliability of controlling of the steel cable retracting/releasing device 51 and cable pressing plate 557 by the steel cable clutch controller 55.

SUMMARY OF THE INVENTION

It is therefore a primary object of the present invention to provide a steel cable lock structure with internal multidirectional locking effect. In the steel cable lock structure, a dog is resiliently deflectable to engage with the ratchets of the reel. When a lower end press button is pressed, an oblique slot of the lower end press button biases and guides the dog. Basically, simply by means of slightly pushing the lower end press button toward the dog, the oblique slot can drive and deflect the dog in conformity with the rotational direction of the reel releasing the steel cable so as to disengage the dog from the ratchets. Therefore, when releasing the steel cable, the pressing force applied to the lower end press button is apparently minified so that the operation is facilitated.

It is a further object of the present invention to provide the above steel cable lock structure in which a stop plate is disposed at rear end of the dog. When the lower end press button is released, the stop plate instantaneously abuts against the steel cable to stop the steel cable from rushing back. In unlocked state, in the case that the lower end press button is not pressed, the steel cable still cannot be drawn out. This is because when the dog is resiliently deflected to constantly engage with the ratchets of the reel, the stop plate also constantly abuts against the steel cable. Moreover, the steel cable is drawn out in such a direction that the dog is more tightly engaged with the ratchets so that the steel cable can be hardly drawn out.

It is still a further object of the present invention to provide the above steel cable lock structure in which the lower end press button, button bar and dog are driven in the same straight line. This obviates the shortcoming of poor reliability of the conventional leverage swinging type.

It is still a further object of the present invention to provide the above steel cable lock structure in which the locking device is formed with numeral windows corresponding to the respective numeral wheels. A window shielding plate is drivingly connected with the upper end press button for pressing the locking device. In unlocked state, when pressing the upper end press button, the correct numbers of the numeral wheels in the windows are shielded by the window shielding plate. Therefore, when unlocked, an unauthorized person can hardly see the numbers.

The present invention can be best understood through the following description and accompanying drawings wherein:

DETAILED DESCRIPTION OF THE PREFERRED EMBODIMENT

Figure 1:
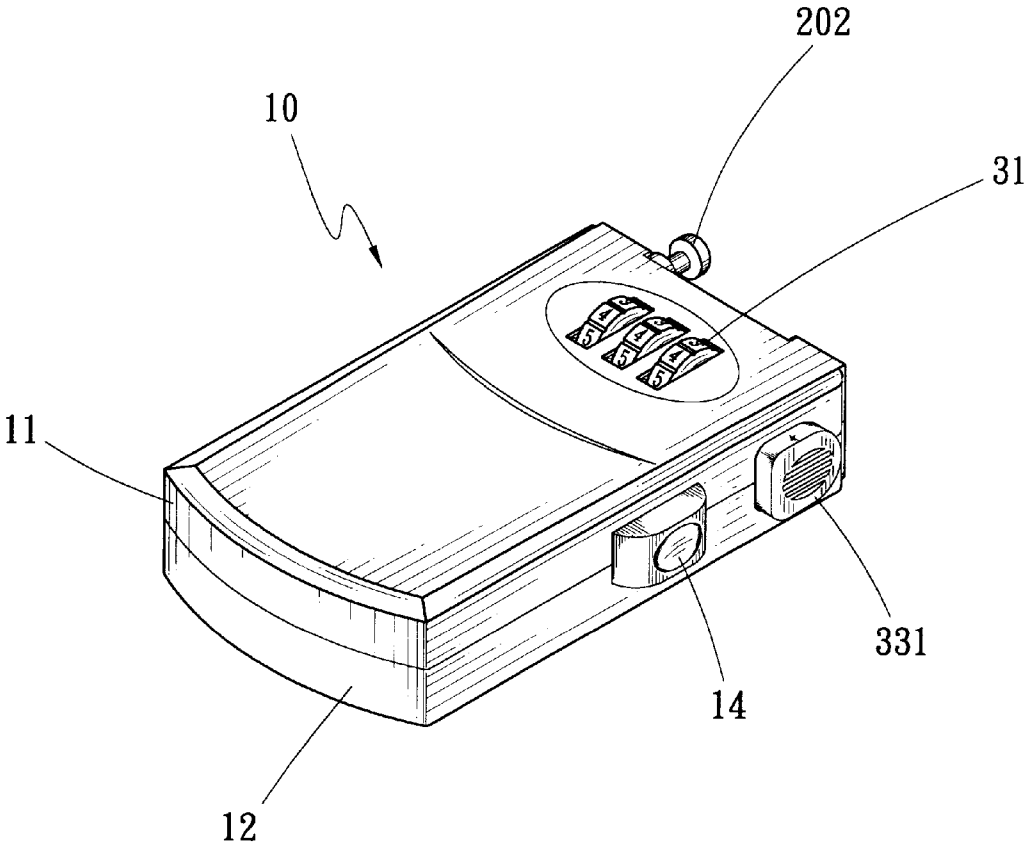
FIG. 1 is a perspective assembled view of the present invention.
Figure 2:
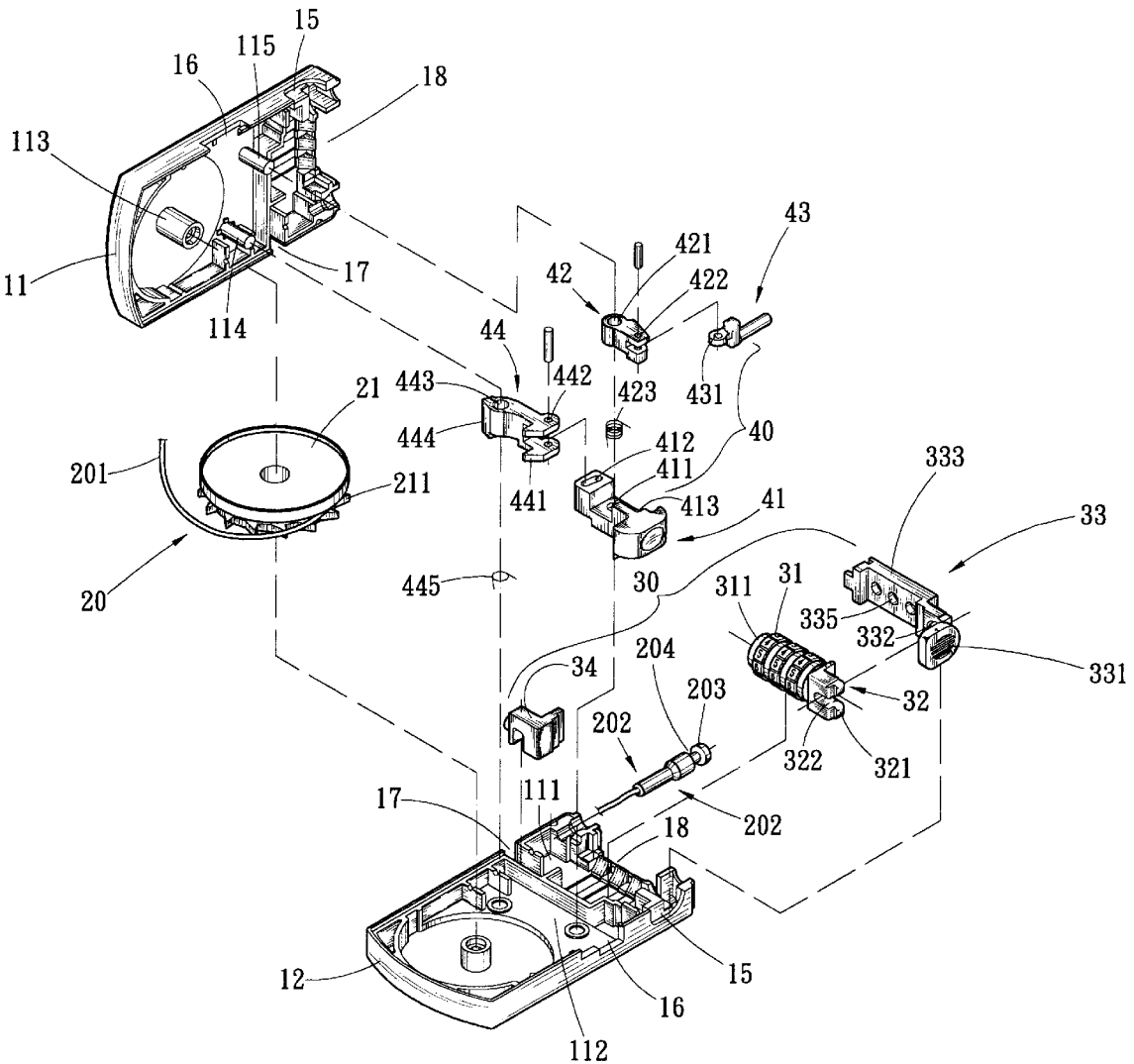
FIG. 2 is a perspective exploded view of the present invention.
Figure 3:
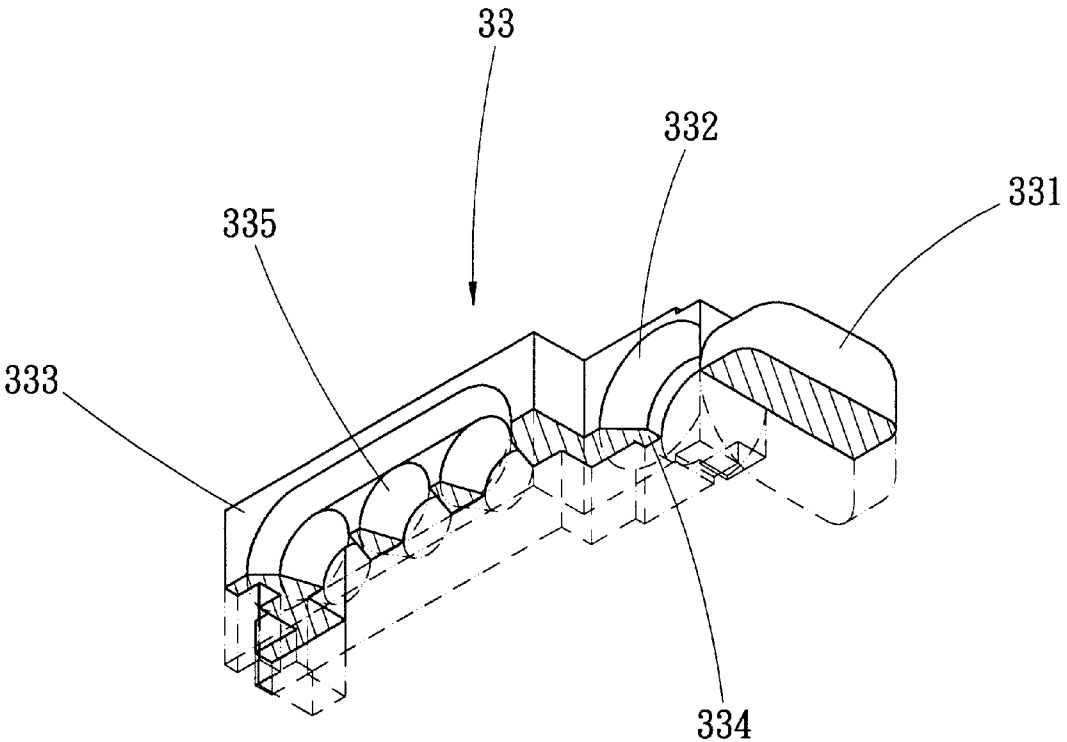
FIG. 3 is a perspective sectional view of the engaging slide block of the present invention.

Please refer to FIGS. 1 to 3. The steel cable lock structure of the present invention includes a housing 10, a cable winding device 20, a locking device 30 and a steel cable clutch controller 40.

The housing 10 is composed of an upper casing 11 and a lower casing 12. The upper and lower casings 11, 12 are mated with each other to define an interior space in the housing 10. The upper end of the space forms a first chamber 111. A second chamber 112 is formed on lower side of the first chamber 111. The center of upper end of the housing 10 is formed with a window 18. Two sides of upper end of the housing 10 are respectively formed with cable head home hole 13 and cable head latch hole 14 inward passing through the housing 10. In addition, an upper end press button hole 15 is formed at upper end of a lateral side of the housing 10 near the cable head latch hole 14. A lower end press button hole 16 is formed on the same lateral side under the upper end press button hole 15. A number-changing press button hole 17 is formed on the other lateral side. The upper casing 11 has a first projecting shaft 113, a second projecting shaft 114 and a third projecting shaft 115 in the second chamber 112 for abutting against the lower casing 12. The first projecting shaft 113 is disposed near the center of the second chamber 112. The second projecting shaft 114 is disposed between the first projecting shaft 113 and the third projecting shaft 115. The third projecting shaft 115 is disposed near the lower edge of the first chamber 111.

The cable winding device 20 includes a reel 21 and a steel cable 201. The reel 21 is pivotally fitted on the first projecting shaft 113 of the second chamber 112. The steel cable 201 is wound on the reel 21. The outer circumference of the reel 21 is formed with multiple ratchets 211. After wound, the outer extending end of the steel cable 201 is connected with an engaging head 202. The front end of the engaging head 202 is formed with a truncated conic block 203 and a neck section 204 downward extending from the truncated conic block 203. The diameter of the neck section 204 is slightly smaller than that of the truncated conic block 203. When the steel cable 201 is totally rewound, the engaging head 202 is stopped and rested on the cable head home hole 13. The steel cable 201 can be pulled out from the housing 10 to finally latch the engaging head 202 of the steel cable 201 into the cable head latch hole 14 of the housing 10 and locked therein.

The locking device 30 is fitted in the first chamber 111 of the housing 10 (referring to FIGS. 2 and 3). The locking device 30 can be a numeral lock composed of multiple numeral wheels 31, multiple sleeves 311, a bolt 32, a locking slide block 33 and a number-changing bar 34. The front end of the bolt 32 is formed with an abutting section 321 and an engaging dent 322. An upper end press button 331 and an insertion opening 332 are disposed on front section of the locking slide block 33. The rear section is formed with a window shielding plate 333 having numeral holes 335. The upper end press button 331 extends in the upper end press button hole 15 of the housing 10. The bottom end of the insertion opening 332 is formed with a bevel flange 334. The abutting section 321 is forced by a resilient member 35 to constantly abut against inner side of the upper end press button 331, whereby the upper end press button 331 always protrudes through the upper end press button hole 15 from the housing 10. Also, the insertion opening 332 always corresponds to the cable head latch hole 14 in which the engaging head 202 is to be inserted. The number-changing bar 34 is disposed in the number-changing press button hole 17 of the housing 10 for pressing the sleeve 311 to unlatch from the numeral wheel 31 so as to reset new unlocking number.

The steel cable clutch controller 40 includes a lower end press button 41, a two-way abutting bar 43, a button bar 42 and a dog 44. The lower end press button 41 is disposed in the housing 10 corresponding to the lower end press button hole 16. The rear edge of front end of the lower end press button 41 is formed with a recessed wall 413. A middle portion is formed with a guide channel 411 and a rear end is formed with an oblique slot 412. The front end of the button bar 42 is formed with a lug 422 pivotally connected with the two-way abutting bar 43. The rear end of the button bar 42 is formed with a pivot hole 421 fitted with the upper end face of the press button 41 having the guide channel 411. The button bar 42 and the press button 41 are together pivoted on the third projecting shaft 115 in the second chamber 112. The upper end of the two-way abutting bar 43 is formed with a circular abutting shaft fitted through the cable head latch hole 14 of the housing 10. When the engaging head 202 is inserted, the circular abutting shaft is pressed by the engaging head 202 to slide in the latch hole 14. The lower end of the two-way abutting bar 43 is formed with a projecting connecting plate 431 for connecting with the lug 422 of the front end of the button bar 42. The front end of the dog 44 is formed with claws 441 having pivot holes 442. The rear end of the dog 44 is formed with a pivot hole 443 and a stop plate 444. The pivot hole 442 of front end of the dog 44 is pivotally connected in the oblique slot 412 of the lower end press button 41. The pivot hole 443 of the rear end is pivotally connected on the second projecting shaft 114.

Figure 4:
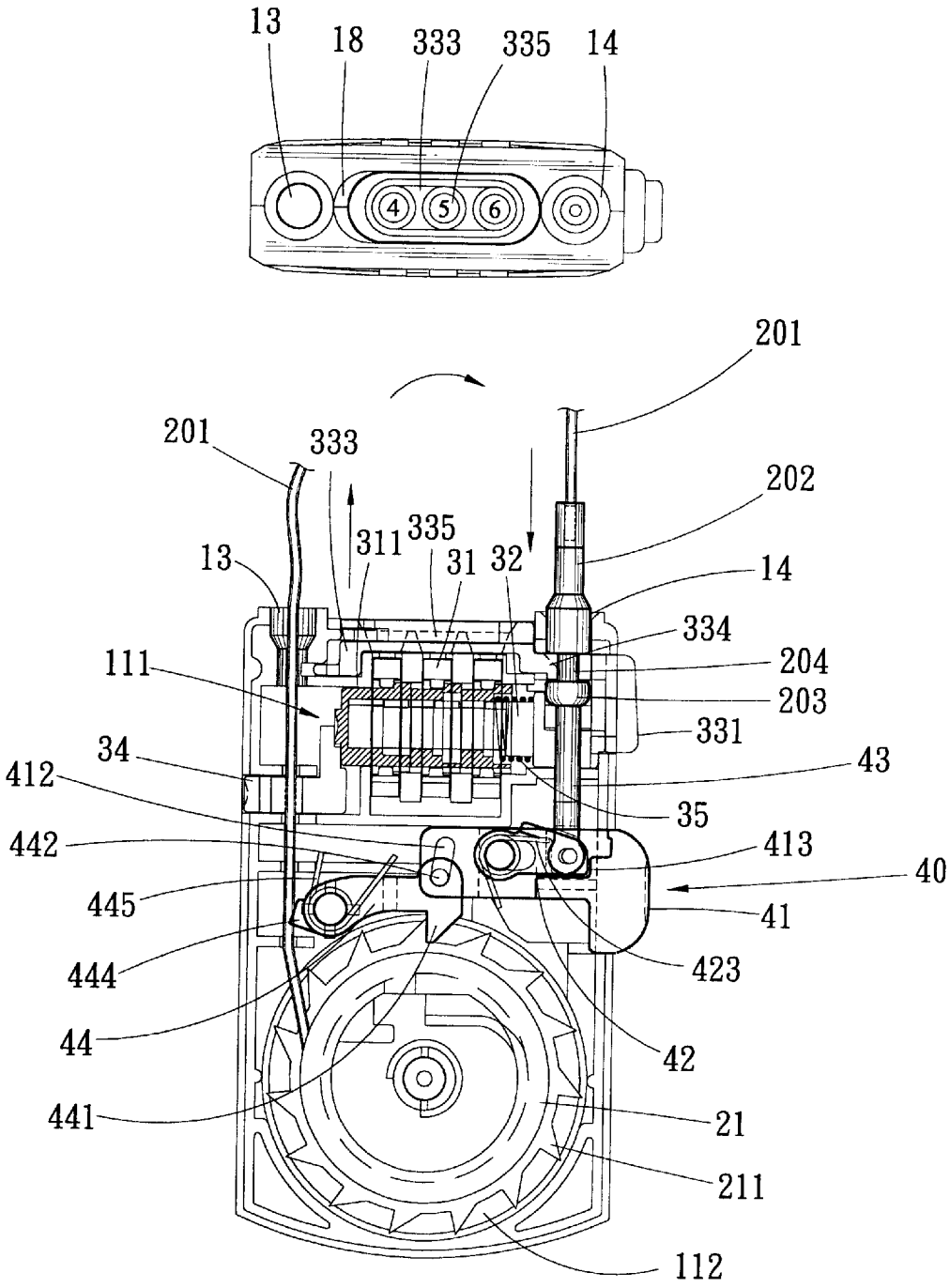
FIG. 4 is a sectional view of the present invention in a locked state.
Figure 5:
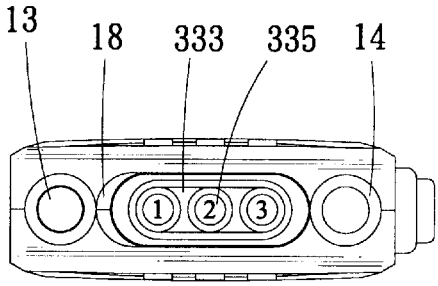
FIG. 5 is a sectional view of the present invention in an unlocked state.
Figure 5:
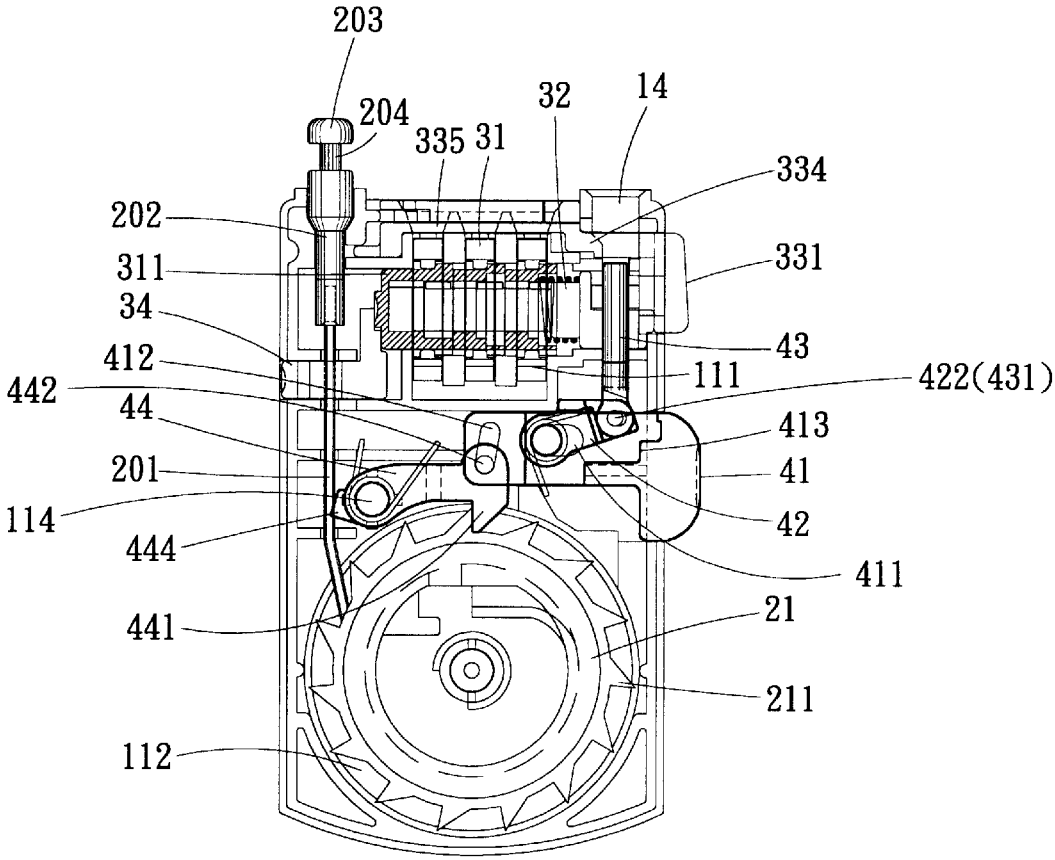
Figure 6:
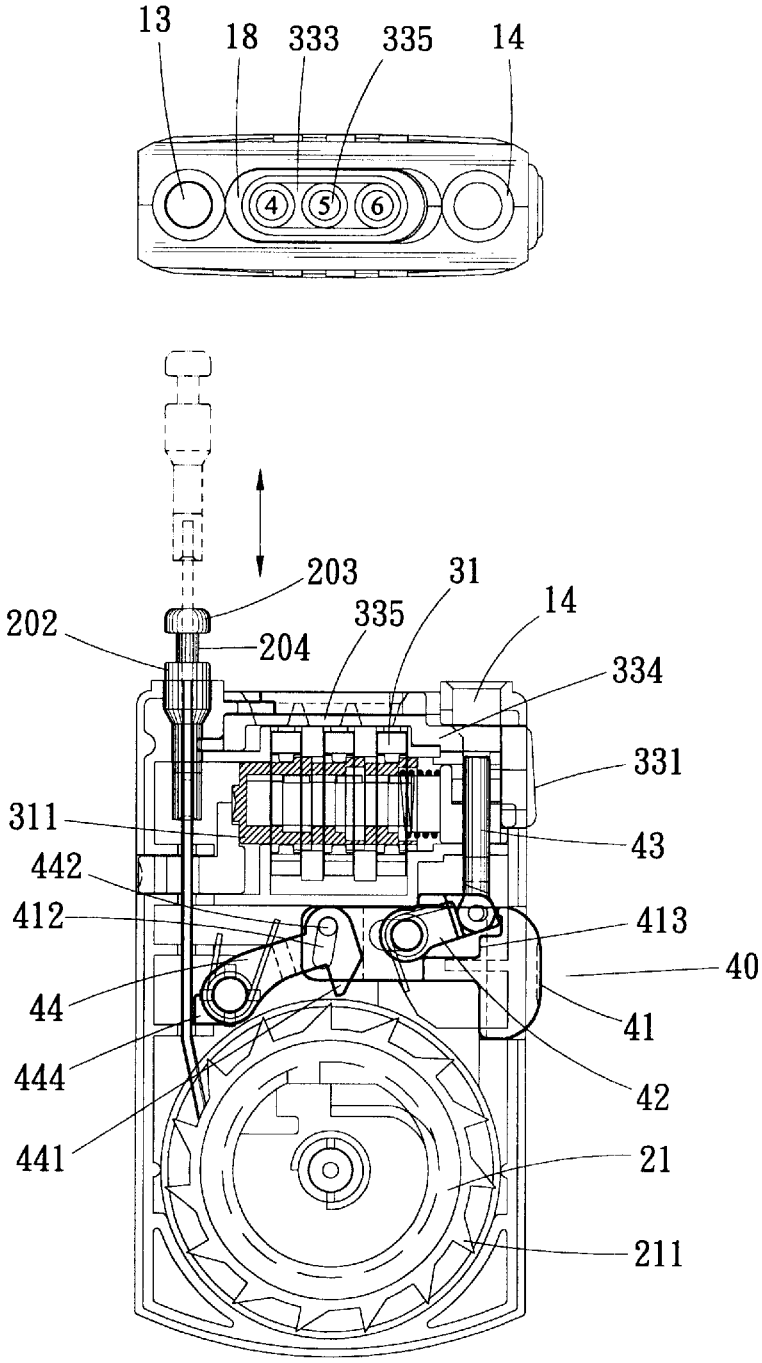
FIG. 6 is a sectional view of the present invention, showing the drawing or winding operation of the steel cable.
Figure 7:
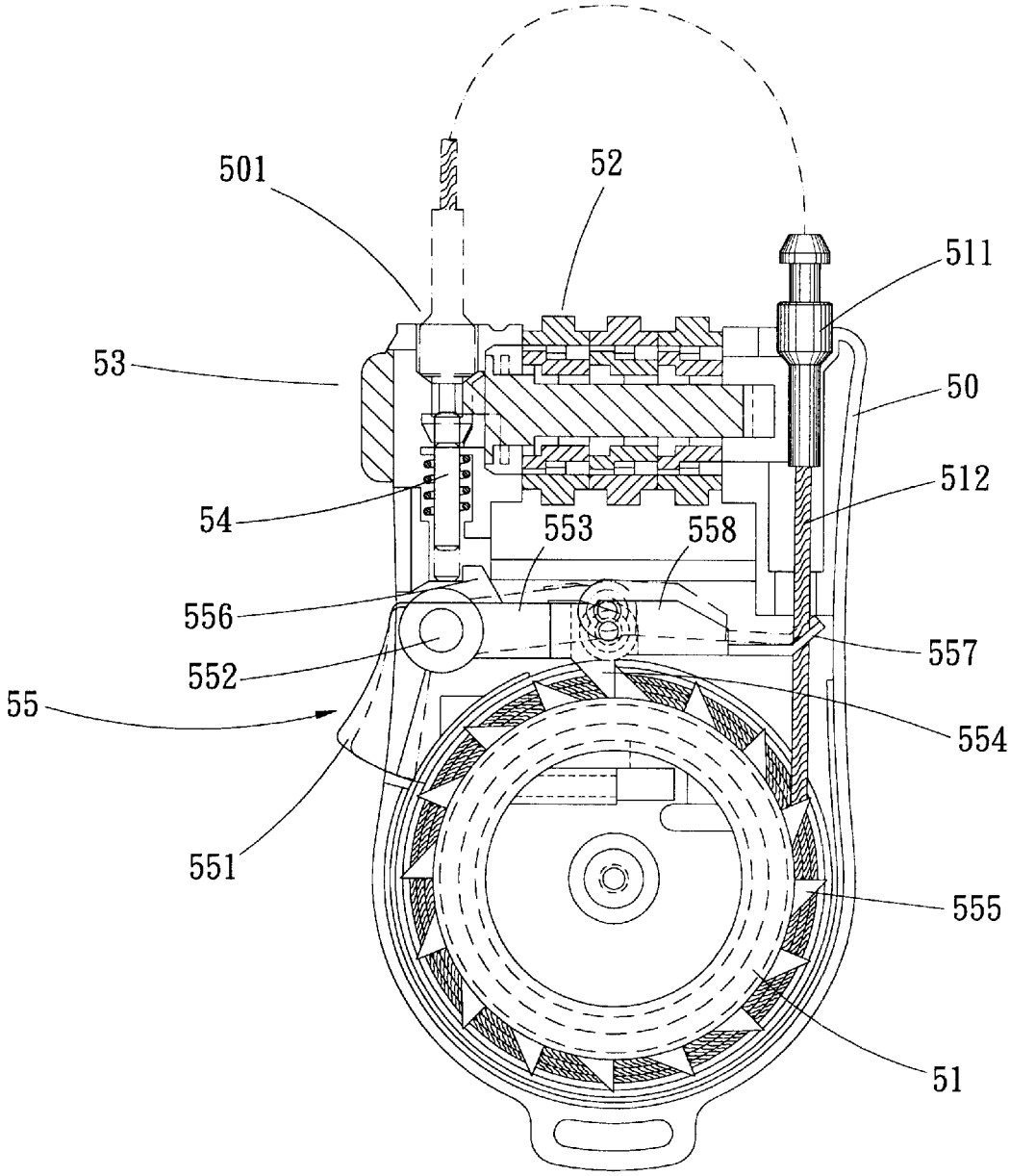
Fig. 7 (Prior Art)
FIG. 7 is a sectional view of a conventional steel cable lock.

Please refer to FIGS. 4 to 6. In operation of the locking device 30, when the numeral wheel 31 is turned to an unlocking number, the lower end press button 41 is pressed into the housing 10, whereby the steel cable 201 can be easily pulled out from the cable head home hole 13 by a certain length. Then the engaging head 202 of the steel cable 201 is latched into the cable head latch hole 14 of the housing 10. Then the numeral wheel 31 is turned to make the upper end press button 331 not pressable, that is, in a locked state. At this time, the bolt 32 cannot be moved into the housing 10 so that the engaging slide block 33 cannot move into the housing 10. Accordingly, the bevel flange 334 of bottom end of the insertion opening 332 is just engaged with the neck section 204 of the engaging head 202, whereby the engaging head 202 is locked in the cable head latch hole 14 and cannot be moved out. At this time, the respective numeral holes 335 of the engaging slide block 33 are just aligned with the numbers of the respective numeral wheels 31 to show the numbers for a user to observe. When unlocked to draw out the engaging head 202, the respective numeral wheels 31 of the locking device 30 are first adjusted to an unlocked state. In such state, the bolt 32 is permitted to move into the housing 10. By means of pressing the upper end press button 331, the bolt 32 is pushed into the housing 10 into an unlocked state. When pressing the upper end press button 331, the bevel flange 334 of bottom end of the insertion opening 332 is disengaged from the neck section 204 of the engaging head 202, whereby the engaging head 202 is permitted to be drawn out of the cable head latch hole 14. In addition, when pressing the upper end press button 331, the window shielding plate 333 is driven and moved, whereby the correct numbers of the numeral wheels 31 are disaligned from the numeral holes 335 of the window shielding plate 333 and shielded by the other part of the window shielding plate 333. Therefore, it is impossible to see the unlocking number through the numeral holes 335. Accordingly, when unlocked, an unauthorized person can hardly see the number. Reversely, when locked, after the upper end press button 331 is released, the unlocking number is adjusted and changed into incorrect number.

FIGS. 4 to 6 show the driving operation of the steel cable clutch controller 40 in unlocked state and locked state. In unlocked state, the button bar 42 is forced by the resilient member 423 so that the two-way abutting bar 43 is constantly pushed toward the cable head latch hole 14. The resilient member 445 also presses the dog 44 toward the reel 21, whereby the lower end press button 41 is forced and pushed by the dog 44 out of the housing 10. Therefore, the dog 44 can always engage with the ratchets 211 of the reel 21. When pressing the lower end press button 41, the pivot shaft in the pivot hole 442 of front end of the dog 44 is biased and upward slided along the oblique slot 412, whereby the dog 44 is disengaged from the ratchets 211 of the reel 21. At the same time, the stop plate 444 of rear end of the dog 44 is retracted into the housing 10 without further abutting against the steel cable 201. Therefore, the steel cable 201 can be drawn out and wound in without being stopped. The dog 44 is constantly resiliently forced by the resilient member 445.

Therefore, when releasing the lower end press button 41, the lower end press button 41 is resiliently driven by the dog 44 to automatically bound out from the housing 10 to its home position. Accordingly, the dog 44 is restored to its home position, that is, the dog 44 is engaged with the ratchets 211 of the reel 21 and the stop plate 444 of rear end of the dog 44 abuts against the steel cable 201 to stop the steel cable 201 from being drawn out. In addition, in locked state, the bevel flange 334 of the engaging slide block 33 is engaged with the neck section 204 of the engaging head 202 so that the engaging head 202 is locked in the cable head latch hole 14. The engaging slide block 33 cannot be moved into the housing 10 so that the upper end press button 331 cannot be pressed to unlock the locking device. Also, the two-way abutting bar 43 is pressed by the conic block 203 of front end of the engaging head 202 to downward drivingly swing the front end of the button bar 42 to engage with the recessed wall 413 of rear side of the lower end press button 41. Therefore, the lower end press button 41 cannot be pressed into the housing 10 so that the dog 44 is kept engaged with the ratchets 211 of the reel 21. Also, in the instant of releasing the lower end press button 41, when the dog 44 is engaged with the reel 21, the stop plate 444 of the dog 44 instantaneously truly abuts against the steel cable 201 to in time stop the steel cable 201 from rushing back or being drawn out.

The above steel cable clutch controller 40 is an improvement of the conventional dog 554. The dog 44 is resiliently swung to engage with the ratchets 211 of the reel 21. When pressing the lower end press button 41, the oblique slot 412 guides and swings the dog 44. In this manner, a user only needs to slightly push the lower end press button 41 toward the dog 44, whereby the oblique slot 412 can drive and deflect the dog 44 in conformity with the rotational direction of the reel 21 releasing the steel cable so as to disengage the dog 44 from the reel 21. This obviates the shortcoming existing in the conventional device and apparently can reduce the application force for pressing the lower end press button 41 to release the steel cable 201. Accordingly, the operation is facilitated. The driving of the lower end press button 41 to the dog 44 is restricted by the linearly driving button bar 42. Therefore, the obvious swinging tolerance caused by the difference between force arm length ratios of the conventional device is eliminated so that the locking effect is true. In addition, the stop plate 444 of rear end of the dog 44 abuts against the steel cable 201, whereby in unlocked state, in case the lower end press button 41 is not pressed, the steel cable 201 is still pressed by the stop plate 444 and hard to draw out. Moreover, when the dog 44 is resiliently deflected to constantly engage with the ratchets 211 of the reel 21, the stop plate 444 synchronously resiliently abuts against the steel cable 201. The drawing direction of the steel cable 201 is such a direction that the dog 44 is more truly engaged with the reel 21. Accordingly, the more the steel cable 201 is drawn out of the housing 10, the stronger the pressing force exerted onto the steel cable 201 by the stop plate 444 is. In contrast, in the conventional device, when the steel cable is drawn out, a push force is exerted onto the cable pressing plate 557 and the button bar 553 to release the same so that the steel cable 512 and the reel can be hardly truly restricted.

In addition, the locking device 30 is formed with numeral holes 335 corresponding to the respective numeral wheels 31. The window shielding plate 333 is drivingly connected with the upper end press button 331. In unlocked state, when pressing the upper end press button 331, the correct numbers of the numeral wheels 31 in the window 18 are shielded by the window shielding plate 333. Accordingly, when unlocked, an unauthorized person can hardly see the numbers.

The above embodiment is only used to illustrate the present invention, not intended to limit the scope thereof. Many modifications of the above embodiment can be made without departing from the spirit of the present invention.

What is claimed is:

1. Steel cable lock structure with internal multidirectional locking effect, comprising a housing, a cable winding device, a locking device and a steel cable clutch controller, wherein:

an interior space is defined in the housing, an upper end of the space forming a first chamber, a lower end of the space forming a second chamber, a cable head home hole and a cable head latch hole being formed through the housing;

the cable winding device including a reel pivotally disposed in the second chamber of the housing, an outer circumference of the reel being formed with multiple ratchets, the steel cable being wound on the reel, after wound, the steel cable extending through the cable head home hole out of the housing, whereby the steel cable can be drawn out and then inserted into the cable head latch hole of the housing, an outer extending end of the steel cable being connected with an engaging head;

the locking device is fitted in the first chamber of the housing for controlling unlocking/locking operation, whereby when the engaging head is inserted into the cable head latch hole, the locking device locks or unlocks the engaging head; and the steel cable clutch controller is disposed in the second chamber of the housing between the locking device and the cable winding device, said steel cable lock structure being characterized in that the steel cable clutch controller includes a lower end press button, a two-way abutting bar, a button bar and a dog, the lower end press button being disposed in the housing corresponding to a lower end press button hole thereof, the lower end press button being formed with a recessed wall, a front end of the lower end press button extending out of the housing, a rear end of the lower end press button extending into the housing to pivotally connect with the dog, a rear end of the button bar being pivotally connected with the lower end press button, an upper end of the two-way abutting bar being fitted in the cable head latch hole of the housing, whereby when the engaging head is inserted, the upper end of the two-way abutting bar is pressed by the engaging head to slide in the latch hole, an inner end of the two-way abutting bar being pivotally connected with the front end of the button bar, the front end of the dog being formed with claws and pivotally disposed at rear end of the lower end press button, an oblique slot being formed on at least one of the pivotally connecting sections of the dog and the lower end press button, the rear end of the dog being pivotally connected in the second chamber of the housing near a position where the cable winding device releasing and retracting the steel cable, whereby when the two-way abutting bar is pressed by the inserted engaging head, the two-way abutting bar cooperates with the button bar to engage in the recessed wall of the lower end press button so as to stop the lower end press button from further moving into the housing and at the same time, the oblique slot drives and guides the dog to make the claws of the dog stop the cable winding device from rotating so that the steel cable cannot be moved out of or into the housing, whereby when the engaging head is inserted and locked, the press button, cable winding device and steel cable are synchronously effectively locked.

2. Steel cable lock structure with internal multidirectional locking effect as claimed in claim 1, wherein a stop plate is disposed at rear end of the dog adjacent to steel cable releasing/retracting opening of the cable winding device, whereby when the lower end press button is released in a locked state, the stop plate naturally presses the steel cable.

3. Steel cable lock structure with internal multidirectional locking effect as claimed in claim 1, wherein the rear end of the button bar is pivoted on a third projecting shaft on the lower end press button, the press button being formed with a guide channel.

4. Steel cable lock structure with internal multidirectional locking effect as claimed in claim 2, wherein the rear end of the button bar is pivoted on a third projecting shaft on the lower end press button, the press button being formed with a guide channel.

5. Steel cable lock structure with internal multidirectional locking effect as claimed in claim 1, wherein the reel of the cable winding device is pivoted on a first projecting shaft near a center of the second chamber.

6. Steel cable lock structure with internal multidirectional locking effect as claimed in claim 2, wherein the reel of the cable winding device is pivoted on a first projecting shaft near a center of the second chamber.

7. Steel cable lock structure with internal multidirectional locking effect as claimed in claim 1, wherein the rear end of the dog is formed with a pivot hole for pivotally connecting the dog on a second projecting shaft on the housing.

8. Steel cable lock structure with internal multidirectional locking effect as claimed in claim 2, wherein the rear end of the dog is formed with a pivot hole for pivotally connecting the dog on a second projecting shaft on the housing.

9. Steel cable lock structure with internal multidirectional locking effect as claimed in claim 1, wherein the locking device is a numeral lock and a numeral window is formed at upper end of the housing.

10. Steel cable lock structure with internal multidirectional locking effect as claimed in claim 2, wherein the locking device is a numeral lock and a numeral window is formed at upper end of the housing.

11. Steel cable lock structure with internal multidirectional locking effect as claimed in claim 9, wherein an upper end press button hole is disposed on one side of the housing near upper end thereof corresponding to the first chamber and the locking device includes an upper end press button passed through the upper end press button hole from inner side of the housing to outer side thereof.

12. Steel cable lock structure with internal multidirectional locking effect as claimed in claim 11, wherein the locking device is a numeral lock composed of several numeral wheels, sleeves, a bolt and an engaging slide block, the upper end press button being disposed at front end of the engaging slide block.

13. Steel cable lock structure with internal multidirectional locking effect as claimed in claim 12, wherein the front end of the bolt is formed with an abutting section and a dent, the engaging slide block being formed with an insertion opening behind the upper end press button, a rear section being formed with a window shielding plate having numeral holes, a resilient member constantly abutting against the abutting section, whereby the upper end press button constantly protrudes through the upper end press button hole from the housing, in natural state, the numeral holes being respectively aligned with the numeral wheels, when the upper end press button is pressed to push the shielding plate to the inner side of the housing, the respective numeral holes being disaligned from the numeral wheels.

14. Steel cable lock structure with internal multidirectional locking effect as claimed in claim 13, wherein a bottom end of the insertion opening is formed with a bevel flange and the rear end of the engaging head is formed with a small diameter neck section, whereby when the engaging head is inserted into the cable head latch hole, the bevel flange is constantly engaged with the neck section of the engaging head, reversely, when the upper end press button is pressed into the housing, the bevel flange is pushed to disengage from the neck section, whereby the engaging head is unlocked and can be drawn out of the cable head latch hole.

15. Steel cable lock structure with internal multidirectional locking effect as claimed in claim 13, wherein the dent of front end of the bolt permits an abutting shaft of upper end of the two-way abutting bar to reciprocally pass therethrough.

* * * * *